US005658172A

United States Patent [19]

Schmidt et al.

[11] Patent Number: 5,658,172

[45] Date of Patent: Aug. 19, 1997

[54] ELECTRICAL POWER DISTRIBUTION ARRANGEMENT

[76] Inventors: Friedrich Schmidt, Rhienstrasse 30, 32791 Lage; Robert Kuells, Im Teiche 37A, 32758 Detmold; Hans-Juergen Kern, Am Stiftsland 11, 32657 Lemgo; Gerhard Huiskamp, Holzhofstrasse 6, 32791 Lage; Rainer Schulze, Schmaler Weg 7, 32760 Detmold, all of Germany

[21] Appl. No.: 598,219

[22] Filed: Feb. 7, 1996

[30] Foreign Application Priority Data

Feb. 10, 1995 [DE] Germany ..... 295 02 186.1

[51] Int. Cl.[6] ..... H01R 9/26

[52] U.S. Cl. ..... 439/716; 439/709

[58] Field of Search ..... 439/709, 715, 439/716, 922

[56] References Cited

U.S. PATENT DOCUMENTS 4,940,431 7/1990 Hennemann ..... 439/715

FOREIGN PATENT DOCUMENTS

| | | |
|---|---|---|
| 0222030 | 5/1987 | European Pat. Off. . |
| 3048497 | 7/1982 | Germany . |
| 68912040 | 6/1994 | Germany . |
| 4322535 | 1/1995 | Germany . |

*Primary Examiner*—Gary F. Paumen
*Assistant Examiner*—Christopher Goins
*Attorney, Agent, or Firm*—Laubscher & Laubscher

[57] ABSTRACT

An electrical power distribution arrangement includes a first terminal block (2) including a main bus bar (5) having a plurality of pole portions (3, 4), a power supply plug connector (8) connected with the first terminal block and including a power supply bus bar (12) electrically connected between a single power supply lead (17) and a first pole-portion (4) of the main bus bar, and at least one tapped output connector (9) having an output bus bar (12') connected with the main bus bar, characterized by the provision of plug-in coupling connectors (15, 15') connected with the power supply and tapped power outlet plug connectors for supplying power from the power supply lead via the first terminal block to a second terminal block of the distribution arrangement.

10 Claims, 4 Drawing Sheets

FIG. 3
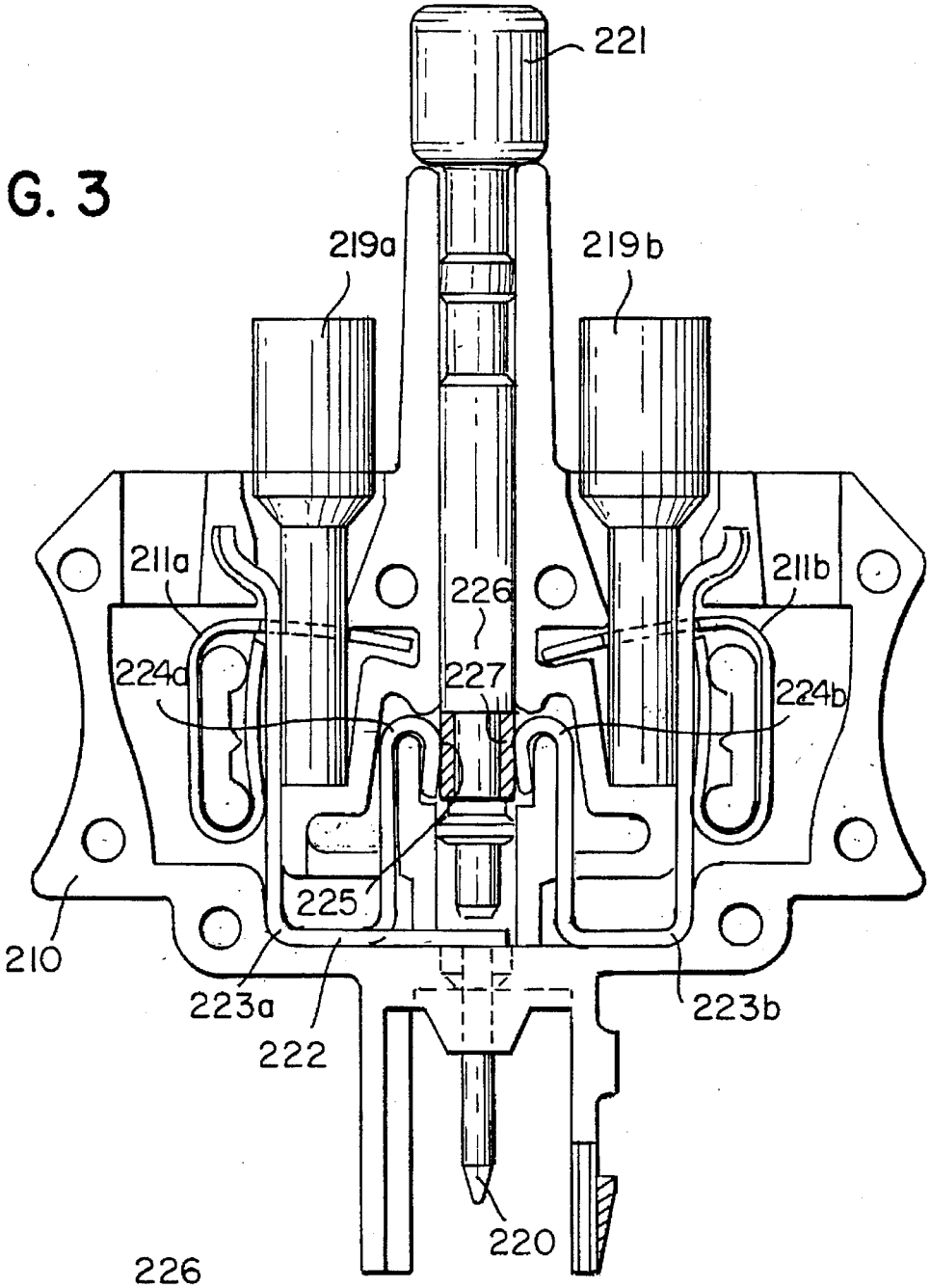
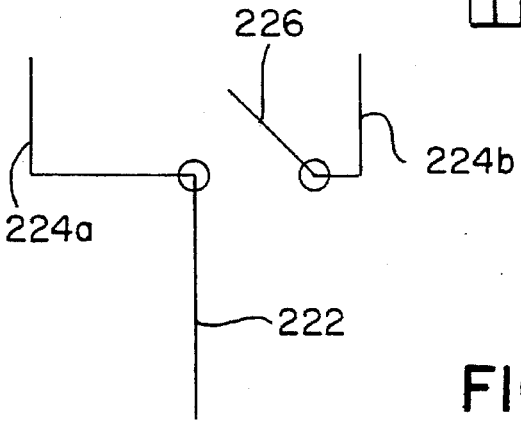
FIG. 3A

FIG. 4
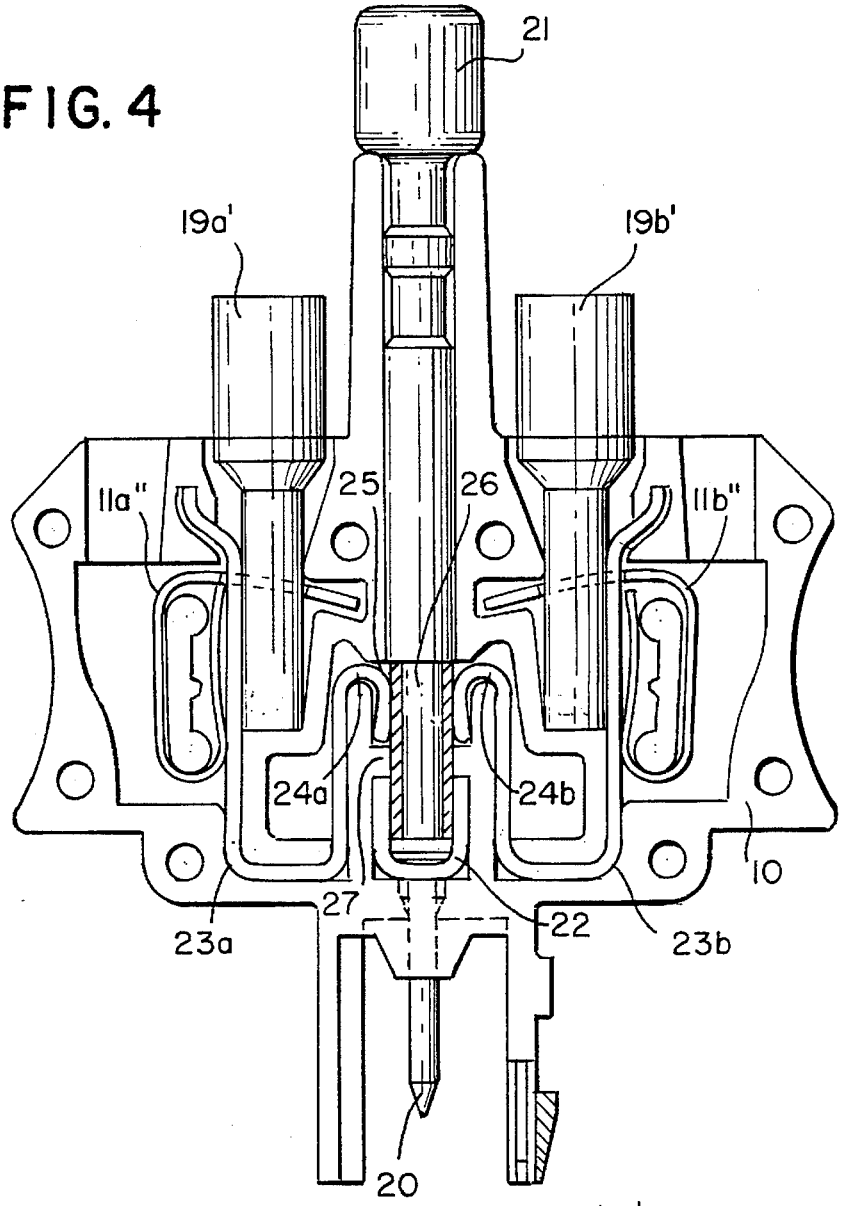
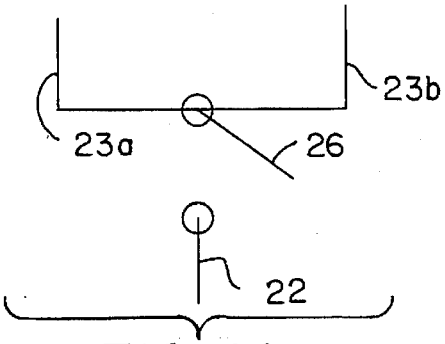
FIG. 4A
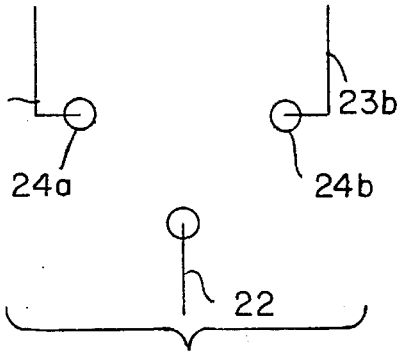
FIG. 4B

ELECTRICAL POWER DISTRIBUTION ARRANGEMENT

SPECIFICATION

CROSS REFERENCE TO RELATED APPLICATION

This application is a companion application to U.S. application Ser. No. 08/550,115 filed Oct. 30, 1995 in the names of Walter Hanning et al, [Our Case No. 18530], and Walter Hanning et al Ser. No. 08/549,645 filed Oct. 27, 1995 [Our Case No. 18529].

FIELD OF INVENTION

This invention relates to an electrical power distribution arrangement including a first terminal block to which power supply and tapped power output plug-in connectors are connected, further plug-in coupling connectors being connected with the power supply and outlet connectors for also supplying power to a laterally arranged second terminal "block of the distribution system."

BRIEF DESCRIPTION OF THE PRIOR ART

As shown by the prior German patent No. DE 9410614U1, it is known to provide a multipole connector bar with one or more connection elements per pole for incoming and outgoing conductor leads that are connected with each other electrically by a connecting piece and to associate with the electrical connection pieces, respectively, an electrical plug connector element for a corresponding plug connector element on the system side, so that after separation of the plug connection, the system will be disconnected from the power supply, although the electrical connection between the incoming and outgoing leads of the supply conductor will remain in effect. The connector here acts in the manner of a connector plug.

The present invention was developed to provide an improved electrical power distribution arrangement in which, with minimal wiring effort and relatively small space requirements, a simple device is afforded for obtaining multiple branching and power taps for supplied electrical power with a multiplicity of design options.

SUMMARY OF THE INVENTION

Accordingly, a primary object of the present invention is to provide a power distribution arrangement including a multipole connector plug for power supply and several multipole connector plugs for the power tap, respectively, with conductor connections and thus via plug connectors connected via bus bar segments corresponding to the number of poles and, furthermore, with a multipole distributor block that is built up in the form of terminal blocks and in whose terminal blocks there are provided, respectively, plug connectors for the particular plug connectors of the connector plug that are electrically connected with each other by bus bar segments, whereby in the multipole connection blocks and their bus bar segments, there are provided plug receptacles for electrical cross-coupling connectors and where the connector and where the connector plug for the power supply are wired only to one pole with an incoming conductor, and where from this conductor connection, the output is distributed via plugged-in cross-coupling connectors to the other pole of the connector plug.

By means of this design, savings are achieved in terms of wiring and thus also in terms of space and assembly as regards the connector plug for the power supply, because one has to perform only one wiring operation and because the power output distribution is accomplished from that pole in this connector plug via the cross-coupling connector. Starting with this one particular power supply point, one can with a minor effort achieve an extraordinarily encompassing power output branching, specifically, via the distributor block to several connector plugs for the power output tap, which thus lead to consumers, if, for example, three such connector plugs are provided for the power output tap and when, for example, as has been provided according to a practical embodiment, each of these connector plugs per pole has two conductor connections for outgoing conductors, so that the output can then be branched six-fold in a multipole manner. Because all connector plugs—in other words, also those for the power tap—have plug receptacles for cross-coupling the power output branching is also extraordinarily variable and capable of further expansion. For instance, considering a specific connector plug, there is a need for adding several additional consumers, then one can put on simple connecting blocks without plug connection to the distributor block and supply them to the latter via a plugged-in cross-coupling connector. Via the cross-coupling, one can also accomplish a further power output cross-distribution on connector bars or the like which do not have their own plug connector possibility to the distributor block but to which one can connect additional consumers.

According to another object of the invention, simple separation of the connected consumers from the main line can be achieved without any need for interrupting that main line. The connector plugs pertaining to the power output tap are simply pulled as needed for testing purposes or maintenance or repair work without any need for turning off any other consumers.

The assembly of an electrical switching system with such electrical distributor arrangement is extraordinarily simplified because no wiring work has to be done at the user's end. One can work in a simple manner with connector plugs with lines that are prefabricated at the manufacturer's end. Final assembly by means of plug connection is simple and can done quickly without any special knowledge.

Special functional tests can be performed easily and independently of each other, for which purpose, when necessary, one can also tap cross-connectors.

According to a preferred embodiment, the cross-coupling for one or more connector plugs is made as a separating plug so that one can use this separating plug to separate individual current paths in the poles of the connector plugs, while other functions on other current paths can be preserved. This leads to specifically targeted disconnects for testing and maintenance purposes—especially on a large scale—while functions that are not involved are extensively maintained.

In another practical embodiment, there is provided in the distributor block that is made up of block a plug receptacle for a cross-coupling connector with which one can electrically connect the bus bar segments of individual blocks, in particular, however, also of a neighboring distributor block, so that in this respect, likewise, an additional power output distribution possibility is created in the area of the distributor block.

BRIEF DESCRIPTION OF THE DRAWINGS

Other objects and advantage of the invention will become apparent from a study of the following specification when viewed in the light of the accompanying drawing, in which:

FIG. 3 is a side elevation view of a modified version of the embodiment of FIG. 2, and FIG. 3*a* is an electrical schematic diagram illustrating the operation of this embodiment;

FIG. 4 is an enlarged side elevation view of one of the tapped power outlet plug; connectors of FIG. 1, and FIGS. 4*a* and 4*b* are electrical schematic diagrams illustrating the operation of the plug connector of FIG. 4.

DETAILED DESCRIPTION

Figure 1:
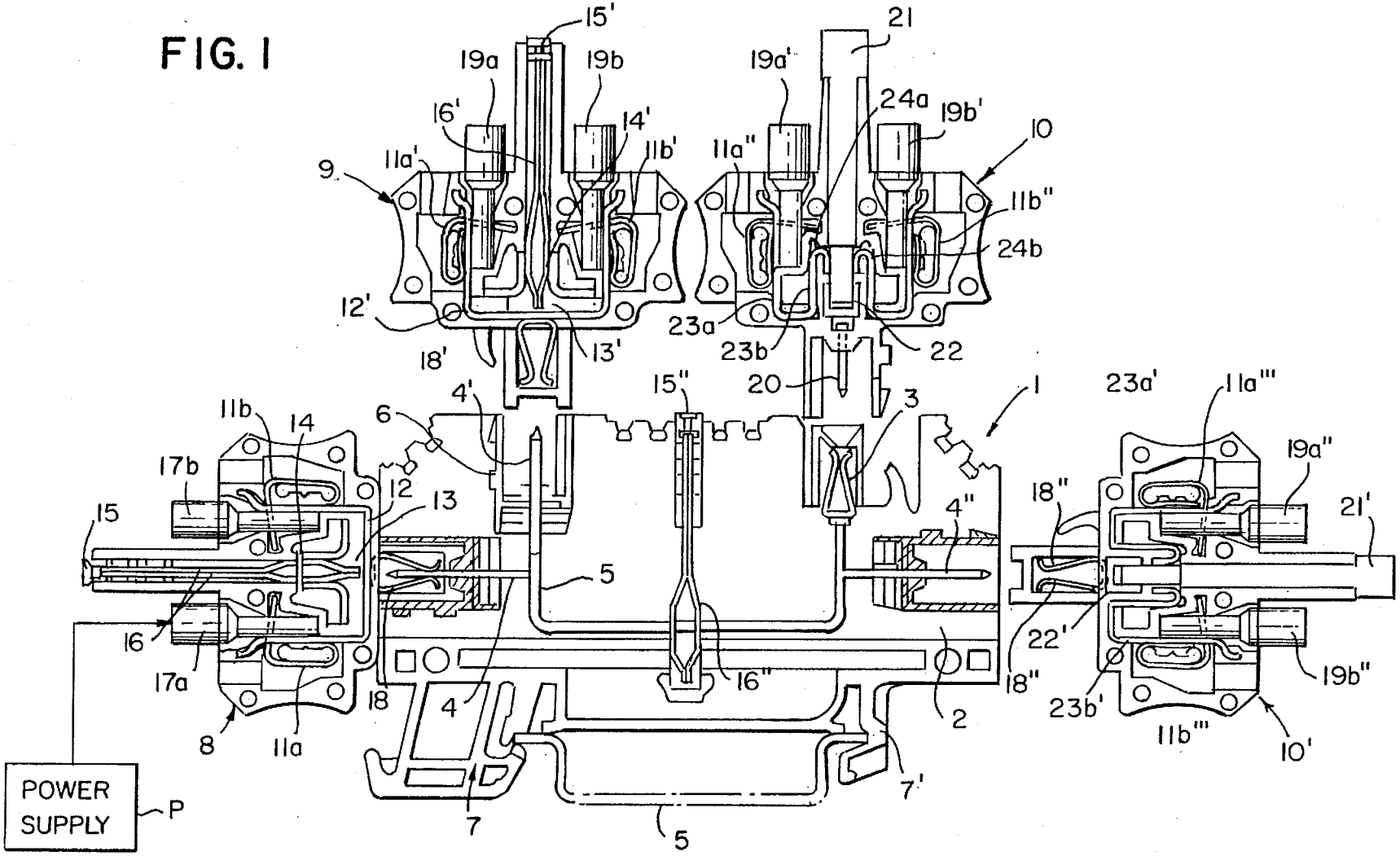
FIG. 1 is an exploded view of the electrical distribution system of the present invention, wherein the power output plugs are disconnected from the main distributor terminal block.

Referring first more particularly to FIG. 1, the electrical power distribution assembly 1 includes a plurality of terminal blocks 2 mounted in side-by-side relation on a common support rail S. The main terminal block body 2 is formed of a suitable synthetic plastic material and contains a main bus bar 5 having a plurality of poles 3, 4, 4', and 4". As shown in FIG. 1, the pole 3 is of a female contact type and the pole 4, 4', and 4" are male pin type contacts.

Removably connected with the main terminal block body 2 are the power supply plug-in connector 8, and an number of power tap-off output connectors 9, 10 and 10'. The power supply connector 8 includes a power supply bus bar 12 that is connected with the pole 4 of the main bus bar 5 by female resilient plug-in contact 18. The power supply bus bar 12 is generally U-shaped and includes a pair of leg portions that are connected with resilient terminal contacts 11*a* and 11*b*, respectively. A single power supply lead 17*a* is provided for supplying power to the distribution block assembly 1. In accordance with a characterizing feature of the invention, the bus bar 12 includes a pair of orthogonally-arranged plate portions 13 and 14 that extend from the opposite side of the female contacts 18. The tab portion 14 contains an opening for receiving the resilient plug-in prongs of a cross coupling connector 15 that serves to laterally transmit power to the adjacent terminal block (not shown) mounted on the support rail S. If desired, a second power supply lead 17*b* may be provided.

The output plug connector 9—which has a similar structure as to power supply plug connector 8—includes a U-shaped bus bar 12' having legs that are connected with the resilient terminals 11*a*' and 11*b*', respectively. The bus bar 12' has orthogonally-extending tab portions 13' and 14', the portion 14' containing an opening for receiving the plug-in prongs 16' of the cross-coupling terminal 15'. The output leads 19*a* and 19*b* are removably connected with the resilient terminals 11*a*' and 11*b*', respectively. The female resilient contact means 18' effects electrical connection with the male pole pin 4' of the main bus bar 5.

A second output plug connector 10 for tapping power from the main terminal block includes bus bar means consisting of a pair of bus-bar sections 23*a* and 23*b* that are connected with the resilient terminals 11*a*" and 11*b*", respectively. The adjacent ends of the bus bar sections include spaced curved portions 24*a* and 24*b* that define therebetween an opening 25 as shown in greater detail in FIG. 4. In this embodiment, the bus bar means includes a further connecting section 22 that is connected with the male pin contact 20 which plugs into the female contact pole of the main bus bar 5. The output leads 19*a*' and 19*b*' are removably connected with the terminals 11*a*" and 11*b*", as shown. The bus bar section 22 is spaced from the neck portions 24*a* and 24*b* that the define the opening 25. A plug-in cross coupling connector 21 has an enlarged end portion 26 provided with a plurality of contact fingers 27 that bridge the neck portions 24*a* and 24*b* of the bus bar means. Similarly, the length of the end portion 26 is such as to also be inserted within the U-shaped bus bar connecting section 22, thereby to connect the neck portions 24*a* and 24*b* with the U-shaped connecting portion 22, whereby end contact 20 is in electrical engagement with the cross coupling connector 21. The plug-in connector 10 has two electrical states as shown in FIGS. 4*a* and 4*b*. Thus, when the power tapping plug connector 10 is plugged into the main terminal block 2, as the cross-coupling connector 21 is progressively inserted into the opening 25 in the output plug-in connector 10, the bus bar sections 23*a* and 23*b* are connected when the enlarged bridging portion 26 is initially inserted into the opening 25. Upon further insertion of the cross-coupling terminal 21 within opening 25, the end portion of the enlarged head 26 engages the opening defined within the connecting bus bar section 22, whereby the enlarged end portion 26 connects the bus bar neck portions 24*a* and 24*b* not only with each other but also with bus bar connecting section 22. Thus, when the cross-coupling contact 21 is fully inserted within the opening 25 as shown in FIGS. 1 and 4, the cross-coupling member 21 is connected with the pin 20, as well as the terminals 11*a*' and 11*b*' via the bus bar sections 23*a* and 23*b*, respectively. The output leads 19*a*' and 19*b*' are thus connected both with the plug-in male contact 20, and with the cross-coupling contact 21.

Referring again to FIG. 1, the third output plug-in connector 10' is of the same configuration as that of the plug 10, the only difference being that the plug-in contacts 18' are of the female type as distinguished from the plug-in pin 20 of the plug connector 10.

The male pole portions 4, 4' and 4" and the main bus bar 5 are supported within synthetic plastic inserts 6, thereby to stabilize the pins within the terminal block. Similarly, a further plug-in cross-coupling contact 15" may be provided having resilient prongs 16" that extend within a corresponding opening contained within the main bus bar 5, thereby to further tap off power to the laterally arranged terminal blocks on the support rail S.

Figure 2:
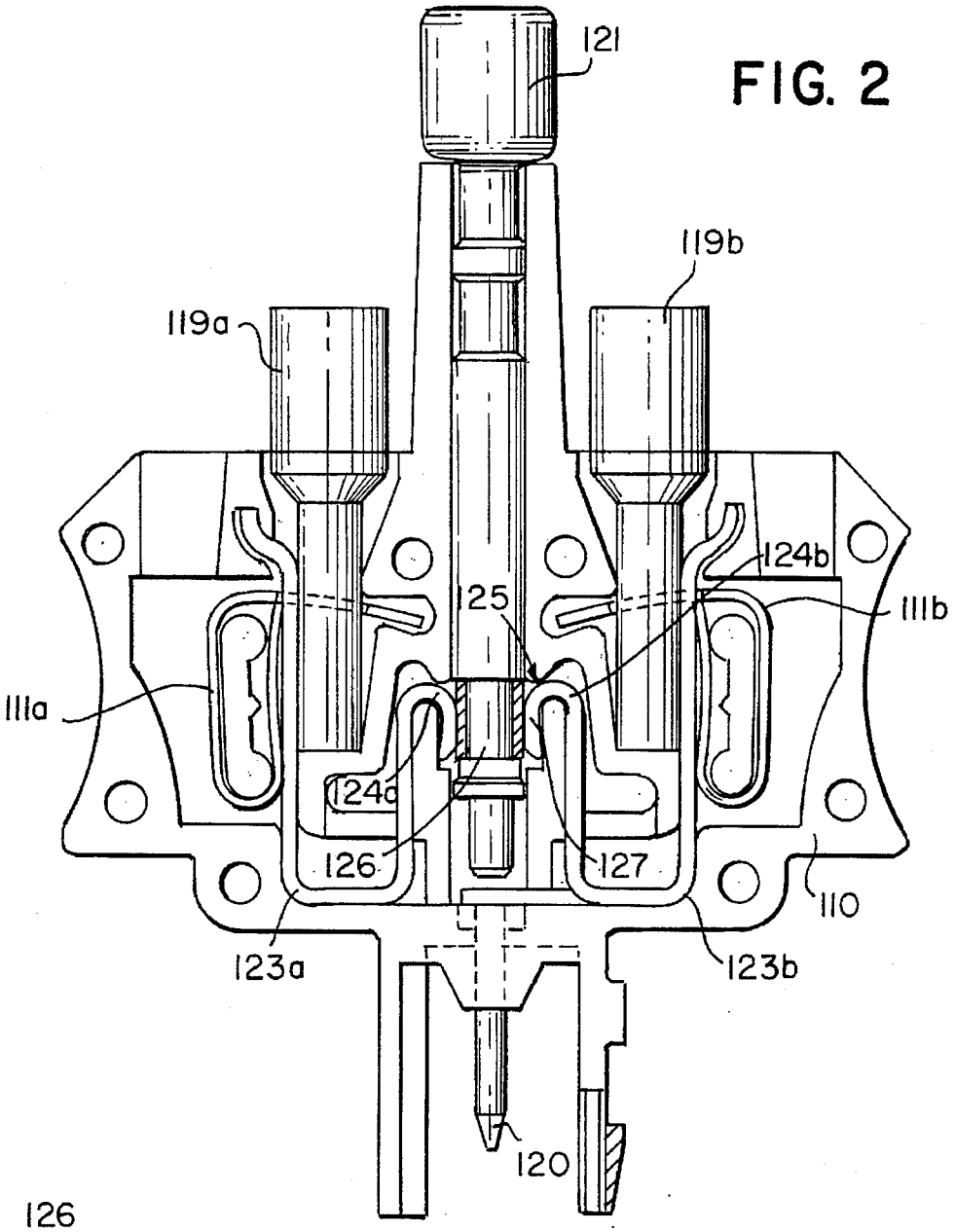
FIG. 2 is a side elevation view of another tapped power outlet plug embodiment.
Figure 2A:
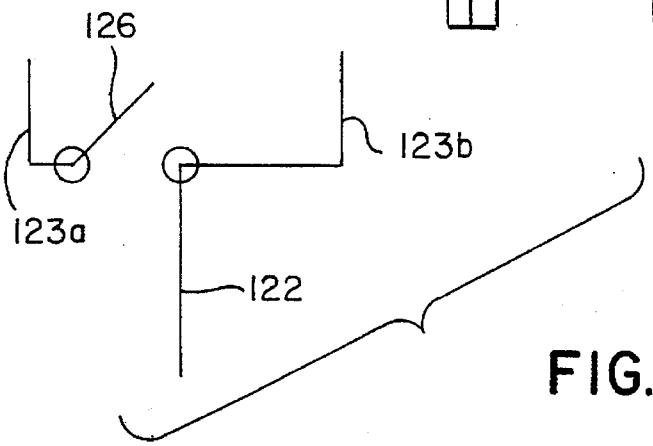
FIG. 2*a* is a schematic wiring diagram illustrating the operation of this plug connector embodiment.

Referring now to the embodiment of FIG. 2, the bus bar section 123*b* includes a coupling portion 122 that is in continuous engagement with the male plug-in contact 20. Thus, the output lead 119*b* is in communication with the pin 120 via bus bar section 123*b* and the extension portion 122. When the cross-coupling plug 121 is inserted within the opening 125 to cause bridging portion 126 to connect the neck portions 124*a* and 124*b*, the output leads 119*a* and 119*b* are both connected with the pin 120 via the bus bar connecting portion 122.

Referring now to FIG. 3, in a similar manner, the bus bar section 223*a* is continuously connected with the male pin member 220 via the bus bar connecting portion 222 that extends from the bus bar section 223*a*. Consequently, in this embodiment, the output lead 219*a* is in continuous communication with the pin 220 via spring contact 211*a*, bus bar section 224*a* and the bus bar coupling portion 222. As the cross-coupling contact 221 is progressively inserted in the opening 225, the enlarged contact head portion 226 bridges the neck portions 222*a* and 224*b*, thereby connecting bus bar section 223*b* and the second output lead 219*b* with the power supply male contact 220.

Consequently, when all of the plug-in connectors 8, 9, 10 and 11 are plugged into the main terminal block body 2, power is supplied from the power source P to the outlet leads 19*a* and 19*b* via bus bar 12, female plug-in contacts 18, and male bus bar contact 4, bus bar 5, male pole portion 4' resilient female terminals 18', bus bar 12' and resilient terminals 11*a'* and 11*b'* Similarly, power supplied to the main bus bar 5 is fed to the output lead 19*a'* and 19*b'* via female plug-in contacts 3 and 20, bus bar connecting section 22, the enlarged head portion 26 of plug-in contacts 21, the bus bar sections 23*a* and 23*b*, and the resilient terminals 11*a"* and 11*b"*. If the contact member 21 were to be partially removed so that the enlarged portion 26 was no longer in engagement with connecting bus bar section 22 but still remained in bridging engagement with the neck portions 24*a* and 24*b* of the bus bar sections 23*a* and 23*b*, respectively, the output leads 9*a'* and 9*b'* would remain electrically connected with each other, but would be disconnected from the plug-in pin 20. Upon further removal of the plug-in contact 21, the neck portions 24*a* and 24*b* would be isolated from each other and from the bus bar portion 22 as shown in FIG. 4*b*, whereby bus bar sections 23*a* and 23*b* and the output leads 19*a'* and 19*b'* would be isolated from each other.

While in accordance with the provision of the Patent Statutes the preferred forms and embodiment of the invention have been illustrated and described, it will be apparent to those skilled in the art that various changes may be made without deviating from the inventive concepts set forth above.

What is claimed is:

1. An electrical distribution system for distributing power from a single power supply lead (17*a*) to a plurality of electrical connectors; comprising:

(a) a first multipole main terminal block (2) including a main bus bar (5) having a plurality of connecting pole portions (3, 4, 4', 4")

(b) a multipole power supply plug connector (8) adjacent a first one (4) of said connecting pole portions, said power supply plug connector including:

(1) power supply bus bar means (12);

(2) plug-in contact means (18) connecting said power supply bus bar means with said first connecting pole portion (4); and (3) means (11) for connecting said power supply bus bar with the power supply lead (17*a*);

(c) at least one output plug connector (9, 10, 10') connected with said main terminal block adjacent a second one of said main bus bar connecting pole portions (3, 4', 4"), said one output plug connector including:

(1) output bus bar means (12'; 23*a*, 23*b*; 23*a'*, 23*b'*) mounted on said one output plug connector;

(2) plug-in contact means (18'; 20, 22, 27; 18", 22', 27') connecting said output bus bar means with said means bus bar second pole portion; and (3) output terminal means (11*a"*, 11*b"*; 11'" 11*b'"*) for connecting said output bus bar means with at least one output lead (19*a*, 19*b*; 19*a'*, 19*b'*; 19*a"*, 19*b"*); and (d) plug-in cross-coupling means (15; 15'; 21; 21') for connecting the bus bar of each of said plug connectors with the terminals of a further multipole terminal block.

2. Apparatus as defined in claim 1, wherein said output terminal means for each output plug connector (9, 10, 10') include a pair of output terminals (11*a'*, 11*b'*; 11*a"*, 11*b"*; 11*a'"*, 11*b'"*) connected with the associated output bus bar means (12'; 22, 23*a*, 23*b*; 22', 23', 23*a'*, 23*b'*).

3. Apparatus as defined in claim 2, wherein said bus bar means of said output plug connector includes plug-in contact means (13, 14) connected with the associated cross-connector means (15').

4. Apparatus as defined in claim 3, wherein said output connector plug (9) and said power supply connector plug (8) have the same structure.

5. Apparatus as defined in claim 2, wherein-said output bus bar means includes a pair of bus bar sections (23*a*, 23*b*; 23*a'*, 23*b'*; 123*a*, 123*b*; 223*a*, 223*b*) each carrying one of said terminals, respectively; and further wherein said cross-coupling means (21, 21', 121, 221) includes bridge means (26, 126, 226) for connecting together the sections of the associate bus means.

6. Apparatus as defined in claim 5, wherein the sections of said output bus bar means include spaced neck portions (24*a*, 24*b*; 124*a*, 124*b*; 224*a*, 224*b*) which define an opening (25, 125, 225) for receiving said bridge means.

7. Apparatus as defined in claim 5, wherein said output bus bar means further includes a hollow third section (22) arranged opposite said bus bar opening for receiving one end of said bridge means, said third section being connected with said means (20; 18") that connects said output bus bar means (23*a*, 23*b*; 23*a'*, 23*b'*) with said main bus bar second pole portion.

8. Apparatus as defined in claim 7, wherein said third section is spaced below the spaced neck portions (24*a*, 24*b*; 24*a'*, 24*b'*) of the associated output bus bar means, thereby to permit successive insertion of said cross-coupling means (21, 21') to place said coupling means initially at a first position connecting said neck portions with each other, and subsequently at a second position connecting said neck portions with each other and with said third bus bar section (22, 22').

9. Apparatus as defined in claim 6, wherein one of said bus bar sections includes an integral coupling portions (122, 222) that is connected with said plug-in contact means.

10. Apparatus as defined in claim 1, wherein said main terminal block includes a further cross-coupling connector (15") directly connected with said main bus bar (5).

* * * * *

UNITED STATES PATENT AND TRADEMARK OFFICE

CERTIFICATE OF CORRECTION

PATENT NO. : 5,658,172

DATED : August 19, 1997

INVENTOR(S) : Friedrich Schmidt, et al.

It is certified that error appears in the above-identified patent and that said Letters Patent is hereby corrected as shown below:

On title page, item [73]

Add

-- Assignee: Weidmüller Interface GmbH & Co. --

Signed and Sealed this

Twentieth Day of April, 1999

*Attest:*

Q. TODD DICKINSON

*Attesting Officer*

*Acting Commissioner of Patents and Trademarks*